US010688651B1

(12) United States Patent
Doose

(10) Patent No.: US 10,688,651 B1
(45) Date of Patent: Jun. 23, 2020

(54) POSITION MARKING APPARATUS

(71) Applicant: Robert L. Doose, Parker, CO (US)

(72) Inventor: Robert L. Doose, Parker, CO (US)

( * ) Notice: Subject to any disclaimer, the term of this patent is extended or adjusted under 35 U.S.C. 154(b) by 231 days.

(21) Appl. No.: 16/023,033

(22) Filed: Jun. 29, 2018

(51) Int. Cl.
*B43L 13/00* (2006.01)
*B25H 7/04* (2006.01)

(52) U.S. Cl.
CPC ..... *B25H 7/045* (2013.01)

(58) Field of Classification Search
CPC ..... B25H 7/045
USPC ..... 33/18.1, 32.1, 36
See application file for complete search history.

(56) References Cited

U.S. PATENT DOCUMENTS 722,381 A 3/1903 Peyton
2,508,468 A * 5/1950 Rathje, Jr. ..... B23Q 35/128 148/196
3,387,371 A * 6/1968 Schneider ..... G06K 1/121 33/18.1
3,390,460 A * 7/1968 Brown ..... B44B 3/00 33/27.01
3,638,319 A * 2/1972 Barlow ..... A63H 11/00 33/18.1
3,753,384 A * 8/1973 Anfindsen ..... B23B 29/12 409/293
4,680,864 A * 7/1987 Heagerty ..... B43L 9/00 33/26
5,195,247 A * 3/1993 Wilcox ..... E04G 21/1891 33/36
5,208,987 A * 5/1993 Christen ..... B43K 7/005 33/18.1
6,745,486 B2 * 6/2004 Stetson-Buck ..... A45D 29/00 132/73.6
7,062,859 B1 * 6/2006 Revnell ..... B43L 13/20 33/32.1
2013/0025146 A1 * 1/2013 Spallino ..... B25H 7/045 33/666
2019/0054611 A1 * 2/2019 Reynolds ..... B25H 7/04
2019/0232713 A1 * 8/2019 Beardsley ..... B25G 3/38

* cited by examiner

*Primary Examiner* — George B Bennett
(74) *Attorney, Agent, or Firm* — Sanchelima & Associates, P.A.; Christian Sanchelima; Jesus Sanchelima

(57) ABSTRACT

The present invention is a position marking apparatus which is implemented for stamping markings on a surface, such as a wood log, at predetermined regular intervals. The position marking apparatus includes a wheel drum having an axle shaft rotatably connected to a rod on one side which extends proximally upwards to a handle for gripping, and optionally a handle extension. The position marking apparatus includes a flange mounted to the outside of the wheel drum, which is larger in diameter than the wheel drum for maintaining the wheel drum on a desired path. The wheel drum has an ink cartridge for containing ink, and at least two ink ejecting slots on the circumference of the wheel drum for marking a separation distance. The position marking apparatus includes a concave spring to ensure proper contact of the wheel drum against the surface to be marked.

15 Claims, 2 Drawing Sheets

POSITION MARKING APPARATUS

BACKGROUND OF THE INVENTION

1. Field of the Invention.

The present disclosure generally relates to a position marking apparatus for stamping markings on a surface at predetermined spaced intervals, and more particularly to a position marking apparatus comprising a wheel device that is made to roll on a surface to stamp markings thereon.

2. Description of the Related Art.

It has been a traditional practice to mark or stamp wood logs manually after its processing in the mill or some factory. Even during handling of wood logs to make objects like furniture, sometimes the carpenter needs to divide the wood log into equal length pieces. Sometimes, even metal sheets or strips have to be cut into equal length pieces. Conventionally, this process of dividing a piece of wood or metal strip is done manually using scales and marking devices, such as pencil. The possibilities or errors and of unevenly spaced markings by this technique are common, and it is also unduly wasteful of time and labor for the large quantities of materials produced in modern continuous mills.

Some tools, like carpenter's wheel gauges, have been devised in the art which allows for making quick markings by rolling a wheel over the surface of the wood. But the known tools suffer from one problem or the other. For instance, known tools are generally not able to compensate for irregularities in the lumber surfaces which can cause improper contact between the marking wheel and the lumber surface thereby producing illegible imprinting. Further, such tools may still require manual intervention for making markings on the surface which is cumbersome and time consuming.

Applicant believes a related reference corresponds to U.S. Pat. No. 722,381 (hereinafter referred to as "the '381 patent") which describes a carpenter's gauge in which toothed wheels are made to revolve on adjustable axles and mark the wood over which they roll. The carpenter's gauge of the '381 patent provide; first, toothed marking-wheels that will climb out of a groove in the wood or over the crooked grain of the wood and be provided each with a long sleeve-like hub to insure its running truly; second, to afford facilities for the proper adjustment of the gage wheel markers, so that they may be held rigidly at the desired distances from each other and from the gage-base or shoulder-slide, and, third, to provide means for extension of the length of the gage-rods when desired and for telescoping them and reducing the instrument to a compact body when not in use.

The carpenter's gauge described in the '381 patent still does not provide any means to ensure that the markings are made in a straight line which could lead to incorrectly spaced markings. Further, the carpenter's gauge described in the '381 patent is not suitable for use on a rough surface or the like. Other documents describing the closest subject matter provide for a number of more or less complicated features that fail to solve the problems described above in an efficient and economical way. None of these patents suggest the novel features of the present invention.

SUMMARY OF THE INVENTION

It is one of the main objectives of the present invention to provide a position marking apparatus for stamping parallel line markings on a surface at predetermined spaced intervals.

It is another objective of the present invention to provide a position marking apparatus with a wheel drum supported to travel in a straight line.

It is yet another objective of the present invention to provide a position marking apparatus designed to interchange wheel drums of different sizes for stamping markings at different spaced intervals.

It is still another objective of the present invention to provide a position marking apparatus which is durable, inexpensive, and easy to handle.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
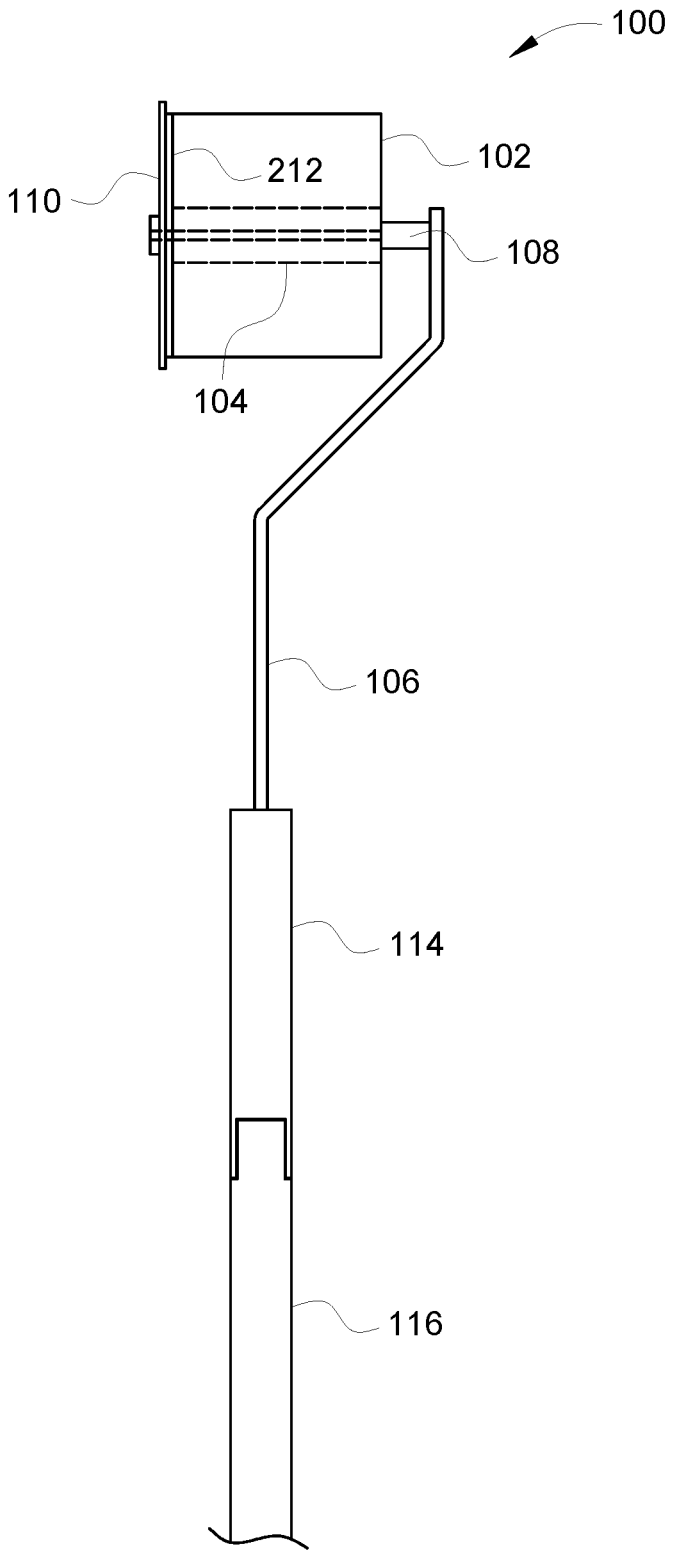
FIG. 1 illustrates a diagrammatic side view of a position marking apparatus 100 with a wheel drum 102, in accordance with one or more embodiments of the present invention.

Referring to the drawings, FIG. 1 illustrate a diagrammatic view of a position marking apparatus (referred by the numeral 100), in accordance with one or more embodiments of the present invention. The position marking apparatus 100 is designed for stamping markings on a surface, such as a wood log or lumber piece, at predetermined spaced intervals, for example for layout of framing members in carpentry or the like. The markings may be in the form of parallel line markings which may be easily noticeable for a user to work on the wood surface for cutting thereof and the like. The position marking apparatus 100 may be implemented for use with existing cutting or similar machinery through which a continuous piece, roll, sheet or strip of material, or any other object to be marked is fed, on to which the position marking apparatus 100 imprints a continuous or repeated pattern, code, date or the like with uniform intensity and sharply defined clarity for convenience of the user.

As illustrated in FIG. 1, the position marking apparatus 100 includes a wheel drum 102 which is generally in the shape of a cylindrical roller. The wheel drum 102 may be made of any suitable rigid material, such as, but not limited to, wood, aluminum, stainless steel, or the like. As may be seen from FIG. 1, the wheel drum 102 may have a sleeve 104 at its center. The position marking apparatus 100 includes a rod 106 which may be rotatably coupled to the wheel drum 102 at one of its distal ends. In particular, the rod 106 may include an axle shaft 108 which may be received inside the sleeve 104 of the wheel drum 102. As may be understood, such arrangement may allow the wheel drum 102 to rotate with respect to the rod 106, or specifically with the movement of the rod 106. These types of arrangements for coupling a handle to a rotating member are well known in the art, for example, in a paint roller or the like.

In an embodiment of the present disclosure, the position marking apparatus 100 includes a flange plate 110 mounted to the outside of the wheel drum 102 towards the planar side opposite to which the rod 106 is attached. As may be seen, the flange plate 110 is larger in diameter than the wheel drum 102. Therefore, the flange plate 110 can be rested against a wall of the surface to be marked while rolling the wheel drum 102 on the surface, and serves as a guide in order for maintaining the wheel drum 102 on a desired straight line path. In one or more examples, the wheel drum 102 may include a drum cap 112 provides at the planar side opposite to which the rod 106 is attached. The flange plate 110 may be snapped and supported on the drum cap 112, in the position marking apparatus 100.

Further, as illustrated, the position marking apparatus 100 includes a handle 114 attached to the rod 106. The handle 114 provides grip to the user while handling the position marking apparatus 100. The handle 114 may be a hollow cylindrical member attached to the rod 106 by any known suitable means. In some examples, the position marking apparatus 100 may optionally include a handle extension 116. The handle extension 116 may be removably attached to the handle 114 by any known means, such as use of fasteners, snap and lock mechanism, groove joint and the like. The handle extension 116 may allow to increase the length of the handle 114 as may be required in some situations for convenience of the user for stamping markings on a surface placed at a distance from reach of the user. The handle 114 and the handle extension 116 may be made of any suitable material, such as, but not limited to, plastic.

Figure 2:
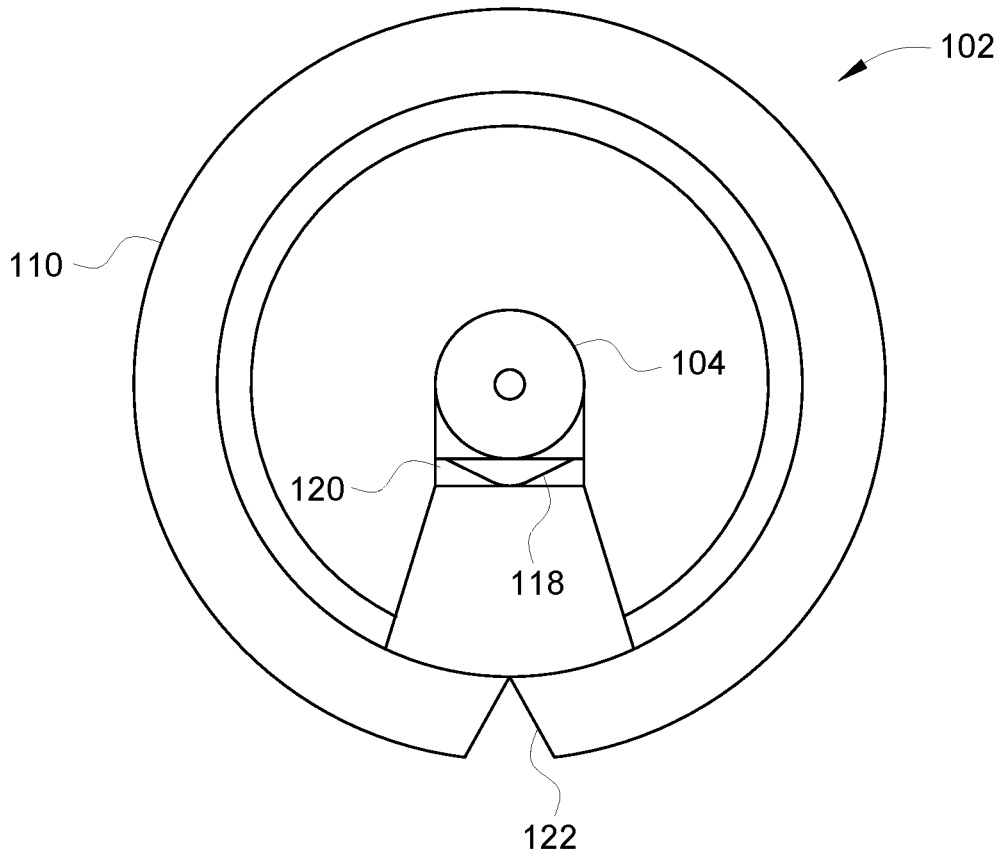
FIG. 2 illustrates a diagrammatic plan view of a wheel drum 102 of the position marking apparatus 100, in accordance with one or more embodiments of the present invention.

Referring to FIG. 2, as illustrated, the position marking apparatus 100 may include an ink cartridge 118. The ink cartridge 118 is an ink reservoir that is housed within a pocket 120 formed within the wheel drum 102. In an example, the ink cartridge 118 is held inside the wheel drum 102 by the flange plate 110. In an exemplary configuration, the ink cartridge 118 includes two ink ejecting slots (not shown). The two ink ejecting slots of the ink cartridge 118 are positioned facing outwardly from the wheel drum 102. Two felt lines (not shown) are mounted to the ink ejecting slots using an adhesive. As may be understood, the only parts of the ink cartridge 118 that are visible from outside the wheel drum 102 are the ink ejecting slots that receive the felt lines. It may be contemplated by a person skilled in the art that by capillary action, the ink wets the felt lines. Thus, the position marking apparatus 100 can be used for marking a surface as the felt lines comes in contact with the surface with every rotation of the wheel drum 102.

In some examples, the position marking apparatus 100 may include a concave spring (not shown) that is positioned at the back of the pocket 120 within the wheel drum 102. Thereby, the concave spring creates a bias against the ink cartridge 118 so that when the felt lines are pressed against the surface, the spring compresses and pushes the felt lines off the surface quicker so that the stamped markings are not smeared, and are formed with uniform intensity and sharply defined clarity. The spring also allows for a smoother roll of the wheel drum 102 because it acts as a suspension system for the position marking apparatus 100. Further, as illustrated in FIG. 2, the position marking apparatus 100 may include an indentation 122 formed on an outer circumference of the wheel drum 102. The indentation 122 may act as a start indicator for the position marking apparatus 100. That is, the user may place the wheel drum 102 on the surface to be marked with the indentation 122 being in contact with the surface, and then the wheel drum 102 may subsequently be rolled on the surface for stamping markings.

In an embodiment, the position marking apparatus 100 may allow for the wheel drum 102 to be interchanged to be able to stamp markings with varying spaced intervals depending on the size of the wheel drum 102. It may be appreciated that the arrangement of using the sleeve 104 and the axle shaft 108 may allow for easy detachment and attachment of the wheel drum 102 to the rod 106. It may be understood that the stamped markings are spaced equal to the outer circumference of the wheel drum 102, since the markings are created with every complete rotation of the wheel drum 102. Generally, the wheel drums 102 are made available in sizes with 16" and 24" of outer circumference; however, it may be understood that the wheel drum 102 may be formed with any other circumference length depending on the markings operations' requirement of the user.

The position marking apparatus 100 of the present disclosure makes it easier for the user to stamp equidistant markings on a surface. The user simply has to hold the position marking apparatus 100 from the handle 114, or the handle extension 116, and roll the wheel drum 102 on the desired surface. As the wheel drum 102 rolls on the surface, the ink from the ink cartridge 118 flows through the felt lines and create markings on the surface with each completed turn of the wheel drum 102. The position marking apparatus 100 with the flange plate 110 being supported against the surface provides that the wheel drum 102 travels in a straight line, thus ensuring properly stamped markings. In order to stamp markings consistently and legibly, it is necessary for the position marking apparatus 100 not only to be capable of proper adjustment, but also that it respond precisely to irregularities in the surface being printed such that at all times the proper force will be applied to the surface during the marking operations. The position marking apparatus 100 of the present disclosure utilizing the concave spring ensures the proper contact even with a rough surface, and thus ensure that proper markings are made during each operation.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A position marking apparatus, comprising:

a wheel drum;

a rod rotatably coupled to the wheel drum from a distal end of the rod;

a flange plate mounted to an outside of the wheel drum; and an ink cartridge housed within a pocket formed within the wheel drum.

2. The position marking apparatus of claim 1, wherein the wheel drum comprises a sleeve at center thereof.

3. The position marking apparatus of claim 2, wherein the rod comprises an axle shaft received inside the sleeve of the wheel drum.

4. The position marking apparatus of claim 1, wherein the flange plate is mounted to the outside of the wheel drum towards a planar side opposite to which the rod is attached.

5. The position marking apparatus of claim 4, wherein the wheel drum comprises a drum cap provided at the planar side opposite to which the rod is attached.

6. The position marking apparatus of claim 5, wherein the flange plate is snapped onto the drum cap.

7. The position marking apparatus of claim 1, wherein the ink cartridge is held inside the wheel drum by the flange plate.

8. The position marking apparatus of claim 1, wherein the ink cartridge includes two ink ejecting slots positioned facing outwardly from the wheel drum.

9. The position marking apparatus of claim 8 further comprising two felt lines mounted to the ink ejecting slots.

10. The position marking apparatus of claim 9, wherein the two felt lines are mounted to the ink ejecting slots using an adhesive.

11. The position marking apparatus of claim 1 further comprising a concave spring positioned at the back of the pocket within the wheel drum.

12. The position marking apparatus of claim 1 further comprising an indentation formed on an outer circumference of the wheel drum.

13. The position marking apparatus of claim 1 further comprising a handle attached to the rod.

14. The position marking apparatus of claim 13 further comprising a handle extension removably attached to the handle.

15. The position marking apparatus of claim 1, wherein the flange plate is larger in diameter than the wheel drum.

* * * * *